United States Patent [19]

Patty

[11] 4,090,185

[45] May 16, 1978

[54] EMERGENCY POSITION-FIXING DEVICE

[76] Inventor: Richard L. Patty, Box 56, New Haven, Ind. 46774

[21] Appl. No.: 630,312

[22] Filed: Nov. 10, 1975

[51] Int. Cl.[2] ..... G08B 23/00

[52] U.S. Cl. ..... 340/321; 340/366 A; 340/366 G

[58] Field of Search ..... 340/321, 280, 366 F, 340/366 G

[56] References Cited

U.S. PATENT DOCUMENTS

| | | | |
|---|---|---|---|
| 1,278,738 | 9/1918 | Petrie | 340/321 |
| 1,527,792 | 2/1925 | French | 340/321 |
| 2,265,670 | 12/1941 | Platt | 340/321 |
| 2,540,341 | 2/1951 | McNail | 340/321 |
| 2,640,980 | 6/1953 | Prupis | 340/321 |
| 2,799,741 | 7/1957 | Ullman | 340/280 |
| 2,825,803 | 3/1958 | Newbrough | 340/366 F |
| 3,192,517 | 6/1965 | Werlin | 340/280 |
| 3,201,771 | 8/1965 | Proulx | 340/321 |
| 3,309,691 | 3/1967 | Bonanno | 340/321 |
| 3,840,853 | 10/1974 | Cukale | 340/321 |
| 3,988,724 | 10/1976 | Anderson | 340/280 |

*Primary Examiner*—Thomas B. Habecker

*Attorney, Agent, or Firm*—Gust, Irish, Jeffers & Rickert

[57] ABSTRACT

A self-contained emergency signaling device is removably mounted to a carrier, such as a fireman's helmet or oxygen tank. While mounted on the carrier, a high-intensity strobe light signals the position of the carrier. When detached from the carrier, a position-fixing sound producer is automatically actuated, in addition to the strobe light.

10 Claims, 6 Drawing Figures

EMERGENCY POSITION-FIXING DEVICE

BACKGROUND OF THE INVENTION

1. Field of the Invention

This invention pertains to emergency position-fixing devices of the kind that are mounted to portable carriers such as hats or emergency life saving equipment.

2. Description of the Prior Art

Illuminating devices have been incorporated in carriers such as fire helmets, miners' hats and hunters' hats for some time. These devices ordinarily are fixed to the helmet or hat and are designed for continuous operation and fixed attachment to the carrier. These devices have proven limited in use due to lack of signaling strength and detachability from the carrier. Further, none have had the capability of fixing a position under exceptionally adverse conditions such as heavy smoke or fog.

SUMMARY OF THE INVENTION

A self-contained signaling device in a detachable housing has both a strobe light of high intensity and a loud horn. The housing is readily attachable to and removable from a carrier such as a helmet or emergency equipment. The horn is automatically actuated upon removal of the housing from the carrier for placement near a victim unable to move or be moved until further aid is obtained. A rescuer, upon finding the victim and realizing additional aid is required, detaches the signaling device and a loud intermittent horn is automatically actuated in addition to the strobing light. Often, due to smoke, fog or inaccessibility to line of sight, a light, even of powerful proportions, is not sufficient to fix the victim's position. A loud intermittent horn sound directs the rescuer back to the victim with the additional needed aid. Also, when a fireman is overcome by smoke or is otherwise disabled, the unit may be removed to signal distress to others in the area. Circuitry which provides high-intensity visual and aural signals for relatively long periods is completely contained in a compact, lightweight, easily worn or carried housing.

An object of this invention is to provide a portable, detachable signaling device that is capable of position-fixing in and under inclement conditions.

A further object is to provide in the device of the foregoing object a signal which is automatically actuated upon detachment of the device from the carrier.

Another object is to provide in the device of the first object both visual and aural signals.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
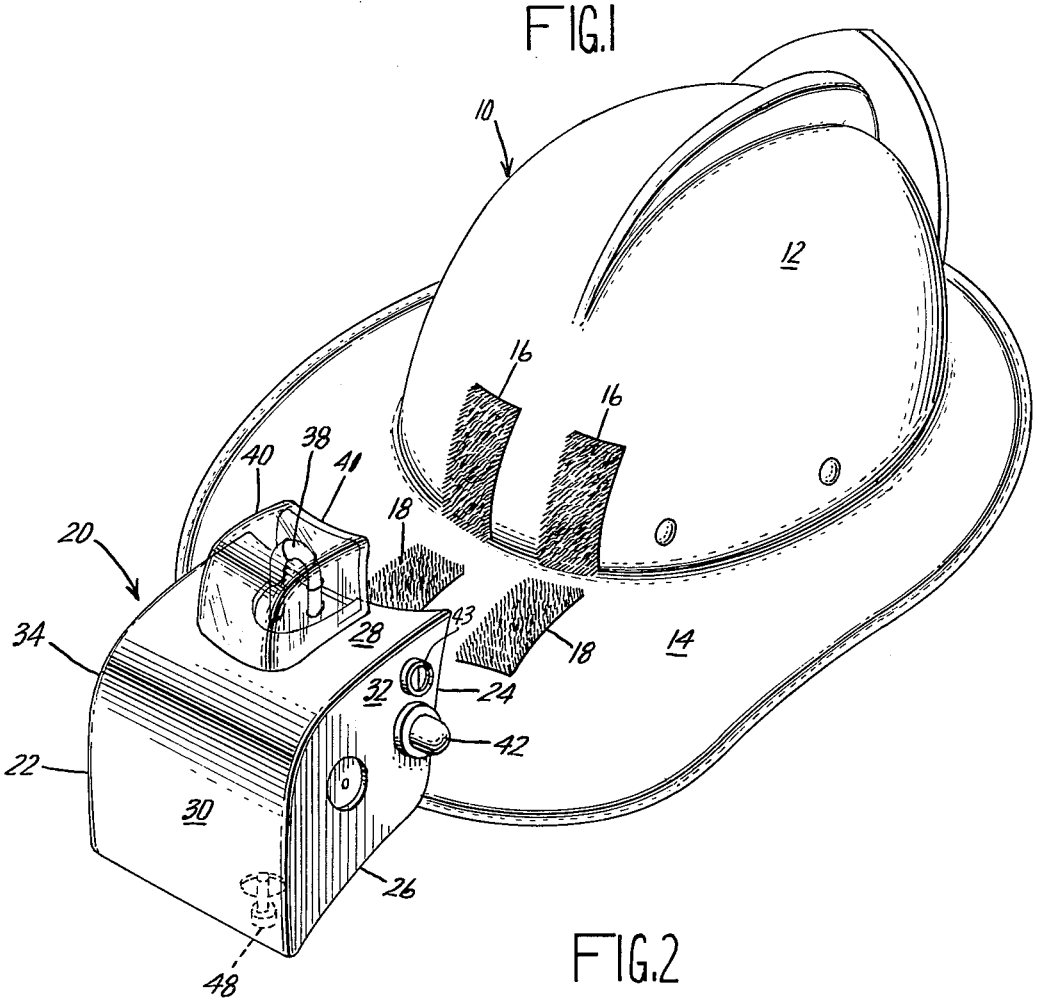
FIG. 1 is a view in perspective of a fireman's helmet shown in detached relation to a preferred embodiment of this invention.
Figure 2:
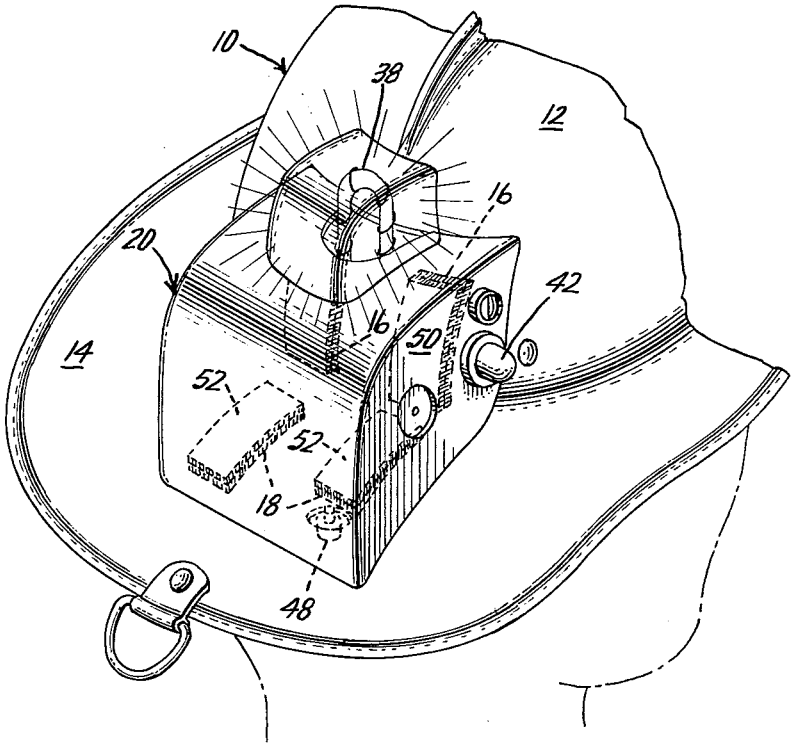
FIG. 2 is a view in perspective of a portion of a fire helmet with the embodiment of FIG. 1 in attached position therewith.
Figure 3:
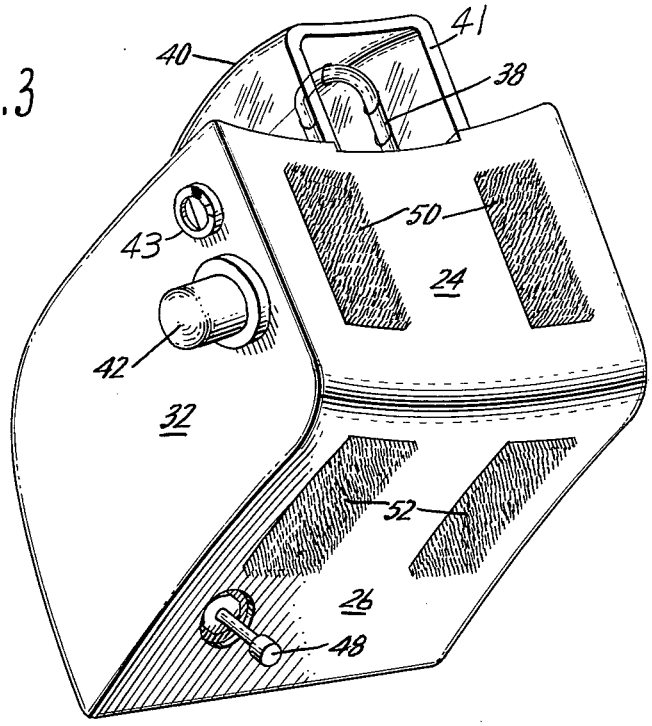
FIG. 3 is a view in perspective of a preferred embodiment of this invention.

Referring to FIGS. 1 to 3, a fire helmet 10 has a crown 12 and a brim 14 attached to the lower peripheral edge of crown 12 in the conventional manner. Two elongated parallel strips 16 of a gripping material, well known and sold by Velcro, Inc., Manchester, N.H., under the trademark "Velcro," are affixed in transversely spaced relation at the rear of crown 12 and extend upwardly from the junction between crown 12 and brim 14. A second pair of elongated, parallel, transversely spaced "Velcro" strips 18 are affixed in longitudinal alignment with strips 16 on the brim 14 with a relatively short longitudinal spacing between strips 16 and strips 18.

Shown in detached relation to helmet 10 is position-fixing device 20 having a housing 22 with a front wall 24 contoured to fit closely against the lower rear portion of crown 12 and an underside 26 which is contoured to fit closely against the rear portion of brim 14. Housing 22 has a topside 28 and a rear wall 30 which are connected to right side wall 32 and left side wall 34.

Extending from topside 28 is flash-tube 38 which radiates high-intensity intermittent illumination. Light 38 is covered and protected by a transparent housing 40 supported by and affixed to topside 28 and has a front edge 41 which is contoured to the upper rear portion of crown 12 to fit closely adjacent thereto. Extending through wall 32 is on-off button 42 and battery charge indicator 43. Extending from bottom 26 is button switch 48 which is spring urged to an outward position, closing the sound circuitry, at which time a loud intermittent sound is generated by sound circuitry later described. When device 20 is attached to helmet 10, switch 48 becomes depressed against the spring action and, as will become evident, interrupts the sound producing circuitry. Affixed to front wall 24 are two elongated, parallel, transversely spaced, strips 50 of "Velcro" material which register with and are adapted to detachably adhere to strips 16. Affixed to underside 26 are two elongated, parallel, transversely spaced strips 52 of "Velcro" material which register with and are of a texture and configuration to detachably adhere to strips 18. Therefore, housing 20 may be placed by the fireman adjacent to crown 12 and brim 14 so that strips 16 register with strips 50 and strips 18 register with strips 52 to detachably support device 20 relative to helmet 10. In this position, the strobe light 38 will be emitting intermittent high-intensity flashes of light, when on-off switch 42 is in the "on" position, although there will be no sound emitting from device 20. However, in an emergency situation where a fireman has located a victim who is unable to move or be moved and needs medical and/or emergency treatment, or the fireman is in distress, he may readily detach device 20 at which time switch 48 automatically becomes extended and turns "on" the sound circuitry emitting a loud intermittent sound. This position fixes the position of the victim even in smoke-filled areas where strobe light 38 would be difficult to see, thereby aiding in location of the victim upon return of the fireman with the necessary emergency or medical aid. Of course, device 20 may be removably attached to helmet 10 by other suitable means known to the art.

Figure 4:
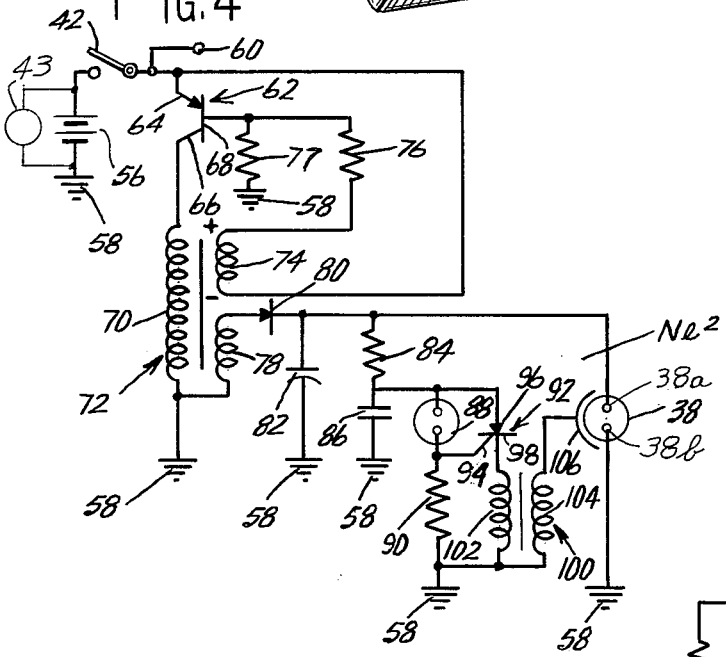
FIG. 4 is a circuit diagram of the strobe light circuitry contained in the embodiment of FIG. 3.

The circuitry for energizing strobe 38, which is entirely self-contained in housing 20, is shown in the circuit diagram of FIG. 4. A battery 56 for supplying between 6 to 9 volts DC and commercially available, is connected to ground 58 at its negative terminal and to switch 42 at its positive terminal. Switch 42, shown in an open position is connected to sound circuit terminal 60, to be later described, and to the emitter 64 of transistor 62. The collector 66 of transistor 62 is connected to one end of primary 70 of transformer 72, the other end of primary 70 being connected to ground 58. Secondary winding 74 of transformer 72 has one terminal connected to one end of current limiting resistor 76 which is connected at its other end to base 68 of transistor 62 and to bias resistor 77 which is connected between base 68 and ground 58. The other terminal of secondary 74 is connected to switch 42.

Secondary winding 78 is connected at one terminal to ground 58 and the other terminal to anode of diode 80, the cathode of which is connected to one plate of capacitor 82, one terminal of resistor 84 and strobe light 38, the other terminal of resistor 84 is connected to one plate od capacitor 86, which has its other plate connected to ground 58 and to one terminal of neon element 88, having its other terminal connected to resistor 90 and to the control electrode 94 of silicon-controlled rectifier 92. The anode 96 of rectifier 92 is connected to the one terminal of neon bulb 88 and the cathode 98 of rectifier 92 is connected to one terminal of primary 102 of transformer 100, the other terminal of primary 102 being connected to ground 58. Neon bulb 88 contains neon gas which conducts when the voltage between its electrodes 88*a* and 88*b* reaches 90 volts.

Secondary 104 of transformer 100 has one terminal connected to the trigger electrode 106 of flash tube or strobe light 38 and the other terminal of secondary 104 is connected to ground 58. In one operating embodiment, the voltage across primary 102 is 400 volts while the voltage across secondary 104 is 4 kilovolts. Tube 38 is a U-shaped tube filled with a rare gas and has anode 38*a* and cold cathode 38*b*. Battery test indicator 43 is connected across battery 56 to indicate its charge condition.

In the operation of the circuit of FIG. 4, closure of switch 42 causes transistor 62 to conduct since the emitter-base junction is forward biased. A voltage of approximately 12 volts is placed across primary 70 of transformer 72 and a voltage of approximately 3 volts is developed across secondary 74 causing transistor 62 to oscillate. The voltage developed across secondary 78 is rectified by diode 80 charging capacitor 82. As capacitor 82 becomes charged, the frequency of oscillation of transistor 62 increases, increasing the charge on capacitor 82. At the same time, the charge on capacitor 86 is being increased; when the voltage across capacitor 86 reaches approximately 90 volts, neon tube 88 fires triggering control electrode 94 of rectifier 92 causing rectifier 92 to conduct placing approximately 400 volts across primary 102 of transformer 100. The voltage across secondary winding 104 is approximately 4 kilovolts which is applied to trigger electrode 106 of flash tube 38, triggering tube 38 "on." The charge on capacitor 82 is then "dumped" through tube 38 causing a brilliant flash which lasts until capacitor 82 is discharged. Tube 38 is then turned "off" and capacitor 82 again begins to charge repeating the cycle. With the component values used in a preferred embodiment, tube 38 flashes once every 2 seconds.

Figure 5:
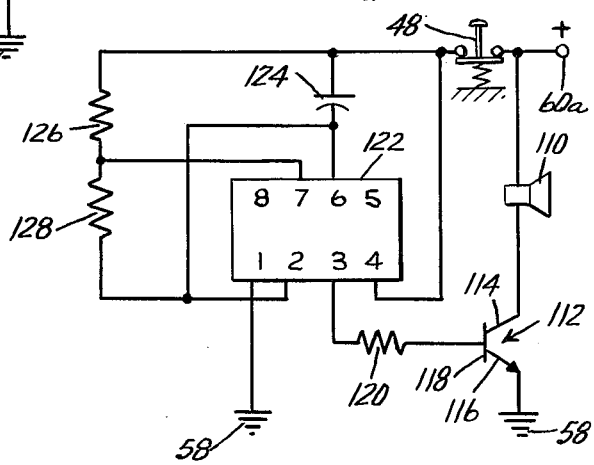
FIG. 5 is a circuit diagram of the position sounding circuitry contained in the embodiment of FIG. 3.

Referring to FIG. 5, a sound signaling circuit is shown having a terminal 60*a* which is connected to terminal 60 in the circuit of FIG. 4 thereby applying battery 56 potential to monostable button switch 48 and speaker 110, the opposite terminal of which is connected to collector 114 of transistor 112. Emitter 116 of transistor 112 is connected to ground 58 while base 118 of transistor 112 is connected to current limiting resistor 120 which is connected to pin 3 of a "555" timer integrated circuit 122.

A "555" timer is known to the art and, very generally, comprises a circuit having a *Vcc* pin, a control voltage pin, a reset pin, a trigger pin, an output pin, a discharge pin and a threshold pin. By connecting a capacitor between a common connection of the threshold pin and discharge pin and ground and by connecting a resistor from the aforesaid common connection to a second common connection of the reset, *Vcc* pins, and a voltage source, a monostable or time delay circuit is obtained, with the period of time delay determined by the values of the resistance and capacitance. The same "555" timer may be used as an astable or free running oscillator by making the following connections of a capacitor and two resistors; one side of the capacitor to a common connection of the trigger and threshold pins and the other side to ground; one resistor between the threshold and discharge pins and a second resistor connected from the discharge pin to a common connection of the reset pin, *Vcc* pin, and a source of V+. Proper selection of the values for the resistors and capacitance determines the frequency of the free running oscillator.

In the description that follows the pins for the timer 122 are numbered and the pin numbers, which are in parenthesis, represent the following:

(1) — Ground
(2) — Trigger
(3) — Output
(4) — Reset
(5) — Control
(6) — Treshold
(7) — Discharge
(8) — Vcc In the timer in this specification, the output terminal is a source of positive voltage approaching the supply voltage and also a sink approaching ground potential.

The other terminal of switch 48 is connected to pin 4 of integrated circuit 122, to one plate of capacitor 124, and through voltage divider resistor 126 to pin 7 of circuit 122. The other plate of capacitor 124 is connected to pin 6 and pin 2 of circuit 122. Voltage divider resistor 128 is connected to resistor 126 and is connected between pins 2 and 7 of circuit 122.

In operation of the circuit of FIG. 5, removal of device 20 from helmet 10 closes switch 48 applying a positive voltage of 5 to 15 volts to pin 4 of circuit 122, to capacitor 124, and to resistor 126 with voltage divider resistors 126 and 128 dividing the voltage and applying a first voltage to pin 7 and a second voltage to pin 2. The timing circuit 122 applies a positive voltage pulse of one second duration to resistor 120 and base 118 of NPN transistor 112, causing the transistor to conduct and speaker 110 to sound. After a predetermined time, the positive voltage at pin 3 is removed, transistor 112 is turned "off" and speaker 110 deenergized. The circuitry of circuit 122 continues to apply at one second intervals for durations of one second, positive pulses to base 118 resulting in a sounding of horn 110 of 1 second on and 1 second off, again providing efficient signaling and use of power from battery 56.

Figure 6:
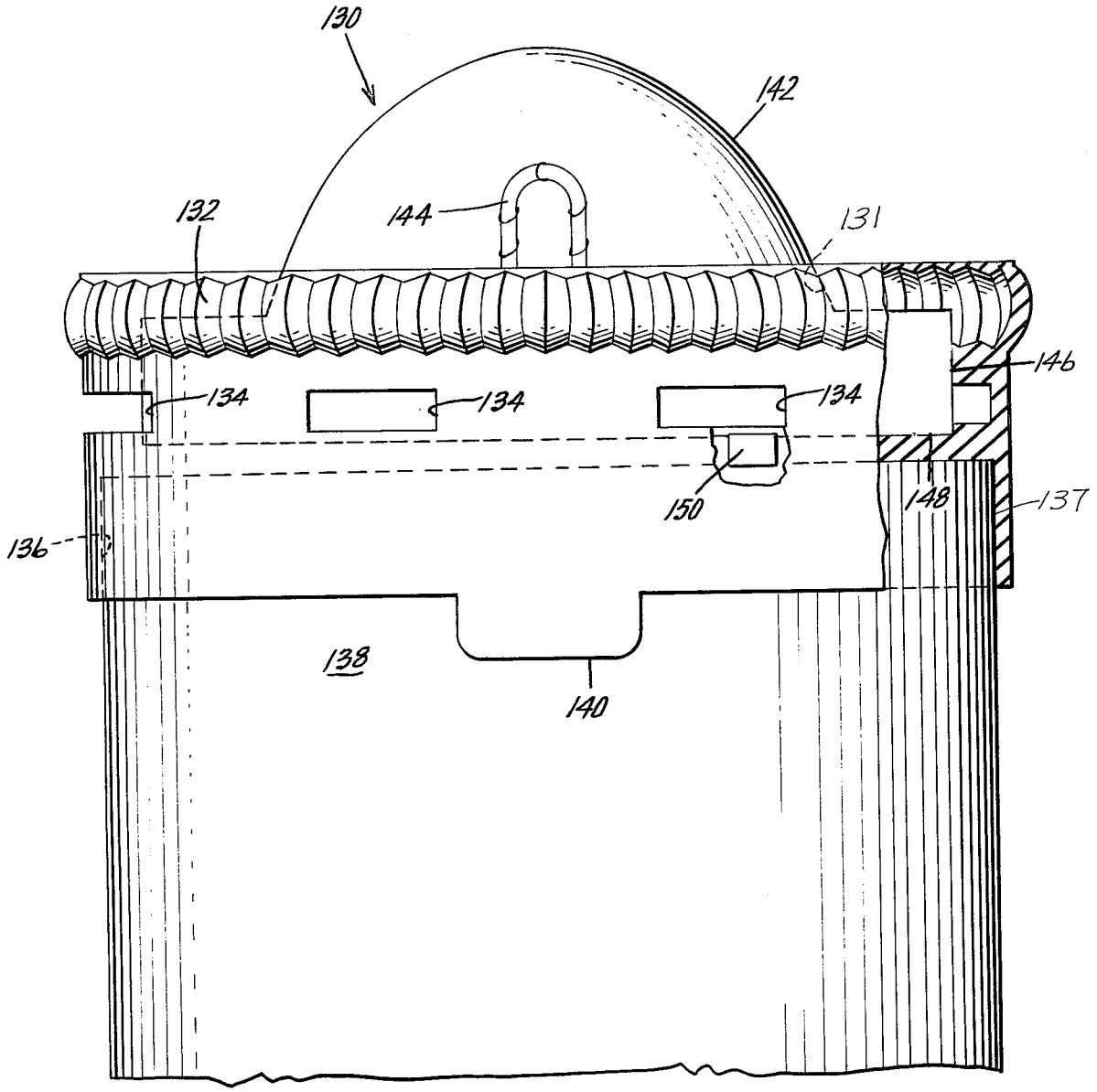
FIG. 6 is a side view of a second embodiment of this invention shown mounted on a top of an oxygen tank, which is partially shown.

A second preferred embodiment is shown in FIG. 6 wherein a position-fixing device 130 is shown mounted to the top of an oxygen tank 138 which is conventionally worn on the back of a rescue worker. A cap 132, which may be of an elastic material such as rubber, has elongate drain holes 134 formed on the periphery thereof and is elastically fitted over the top 137 of tank 138, the inner surface 136 of cap 132 being in surface contact with top 137. Cap 132 has diametrically opposed tabs 140 adapted for finger engagement to attach and detach cap 132 from the top of tank 138. Transparent bubble 142 protrudes through opening 131 of cap 132 and houses a strobe light 144. Bubble 142 may be made of a transparent plastic such as a plastic marketed by the General Electric Company under the trademark of "Lexan" or other suitable transparent material. Bubble 142 is an integral part of a casing 146 which is mounted in the upper portion of housing 132 and completely contains the circuitry of FIGS. 4 and 5 for the aforementioned embodiment. Extending from the bottom 148 of casing 146 is spring-urged button switch 150, which corresponds to switch 48 in the circuit of FIG. 5. Switch 150 is normally extended to an "on" position but when device 130 is assembled on tank 138, switch 150 is depressed to an "off" position, in a similar manner to switch 48 for the embodiment shown in FIGS. 1 to 5 when housing 22 is attached to helmet 10.

In operation of the embodiment shown in FIG. 6, cap 132 is fitted over the top of tank 138, switch 150 is depressed, deenergizing the intermittent sound circuitry while strobe light 144 is intermittently flashing a positioning signal. When the rescuer wishes to provide a position-fix for a disabled victim while leaving to procure medical and other aid, he simply lifts cap 132 from tank 138 by grasping tabs 140 and lifting cap 132 from tank 138. At this point, switch 150 becomes extended and the intermittent buzzer is energized, thus providing visual and aural position-fixing radiations.

While there have been described above the principles of this invention in connection with specific apparatus, it is to be clearly understood that this description is made only by way of example and not as a limitation to the scope of the invention.

What is claimed is:

1. Position fixing apparatus comprising:

a housing;

first signal generating means for generating a human discernible signal; said means being self-contained in said housing;

attaching means affixed to said housing for removeable attachment of said housing to an attaching surface; and first switch means in said housing for automatically disabling said signal responsive to the attaching of said housing to the attaching surface and for automatically continually enabling said signal of said housing from the attaching surface.

2. Apparatus according to claim 1 wherein said attaching means comprises a strip of attaching material affixed to said generating means and a strip of mating attaching material affixed to said attaching surface.

3. Apparatus according to claim 1 wherein said discernible signal is an intermittent audible signal.

4. Apparatus according to claim 1 wherein said attaching surface is a fireman's helmet, said switch means comprising a button in depressible contact with said helmet when said attaching means is attached to said helmet.

5. Apparatus according to claim 1 wherein said first switch means comprises a monostable switch having a spring to spring urge said switch to a closed position for enabling said signal generating means, said switch engagable with the attaching surface and movable against said spring to an open position by the attachment of said generating means to said attaching surface, and said switch movable by said spring to a closed position upon detachment from said attaching surface.

6. Apparatus according to claim 5 including second signal generating means for generating a second discernible signal; second switch means for manually disabling said first and second signal generating means; said housing having a second surface for supporting a transparent cover for displaying the signal of said second generating means; said second switch means being accessible exteriorly of said housing thereby providing a self-contained, removeable signal generating means.

7. Apparatus according to claim 1 including second signal generating means in said housing for generating a second discernible signal; and second switch means for manually disabling said first signal generating means and manually energizing and de-energizing the second signal generating means.

8. Apparatus according to claim 7 wherein said discernible signal is an audibly discernible signal and said second discernible signal is a visually discernible signal.

9. Apparatus according to claim 8 wherein said second discernible signal is a strobe light.

10. Apparatus according to claim 8 wherein said attaching surface is an elongate tank; an elastic cap having an opening centrally thereof fittable over an end of said tank; a housing for said first and second generating means having a transparent bulbous protrusion for visible display of said second discernible signal; said housing being inserted in said cap and said protrusion extending through said opening; said switch means comprising a button extending from said housing and in depressible contact with said tank when said cap is fitted over an end of said tank.

* * * * *